US009376781B2

(12) United States Patent
Staller

(10) Patent No.: US 9,376,781 B2
(45) Date of Patent: Jun. 28, 2016

(54) GROUND ANCHOR LOCK

(71) Applicant: Todd Staller, Eutawville, SC (US)

(72) Inventor: Todd Staller, Eutawville, SC (US)

( * ) Notice: Subject to any disclaimer, the term of this patent is extended or adjusted under 35 U.S.C. 154(b) by 349 days.

(21) Appl. No.: 14/068,743

(22) Filed: Oct. 31, 2013

(65) Prior Publication Data

US 2015/0114053 A1 Apr. 30, 2015

(51) Int. Cl.
*E02D 1/00* (2006.01)
*E04H 12/22* (2006.01)
*E05G 1/00* (2006.01)

(52) U.S. Cl.
CPC ..... *E02D 1/00* (2013.01); *E04H 12/2223* (2013.01); *E05G 1/005* (2013.01); *E05G 1/00* (2013.01); *Y10T 70/5571* (2015.04)

(58) Field of Classification Search
CPC . E04H 12/2223; E04H 12/2215; E02D 5/801; E04B 1/34347; E05B 73/00; Y10S 52/11; Y10T 70/5009; Y10T 70/5566; A45F 3/44; E05G 1/005
USPC ..... 70/14, 416, 417, 32–34; 52/157
See application file for complete search history.

(56) References Cited

U.S. PATENT DOCUMENTS 3,295,274 A * 1/1967 Fulton ..... A63B 71/02 182/107
5,855,129 A * 1/1999 Warren ..... B62H 3/00 70/234
6,829,915 B1 * 12/2004 Li ..... B60D 1/60 280/507
2007/0240367 A1 * 10/2007 Brown ..... A01K 97/10 52/155
2008/0302028 A1 * 12/2008 Lewenhoff ..... E02D 5/80 52/157
2010/0300017 A1 * 12/2010 Bulloch ..... B63B 21/40 52/157
2011/0005148 A1 * 1/2011 Foster ..... E02D 5/56 52/157
2011/0131895 A1 * 6/2011 Dempsey ..... E02D 5/80 52/157
2015/0040491 A1 * 2/2015 Frank ..... E02D 27/00 52/157
2015/0247336 A1 * 9/2015 Bergman ..... E04H 12/2223 52/157

* cited by examiner

*Primary Examiner* — Suzanne Barrett
(74) *Attorney, Agent, or Firm* — Thrive IP; Jay F. Williams; Jeremy M. Stipkala

(57) ABSTRACT

A ground anchor having an elongated shaft with upper and lower ends, a grooved locking post on the upper end; an threaded auger fixed to the lower end, an engagement area for engaging an external tool, a sleeve mounted over the main shaft, which spins freely, and an attachment member configured to secure one or more of an external lock, chain, rope or cable attached to an external object to thereby anchor the external object when the main shaft is screwed into the ground, and a lock device configured to cover and lock onto the grooved locking post so the attachment member and sleeve cannot be removed, whereby the sleeve covers the main shaft and obstructs access to the main shaft to prevent unwanted persons from removing it.

9 Claims, 6 Drawing Sheets

GROUND ANCHOR LOCK

FIELD

This application relates generally to the field of devices, systems, and methods for securing personal objects to the ground to prevent them from being removed or stolen.

BACKGROUND

Citation of any document herein is not intended as an admission that such document is pertinent prior art, or considered material to the patentability of any claim of the present application. Any statement as to content or a date of any document is based on the information available to applicant at the time of filing and does not constitute an admission as to the correctness of such a statement.

People often use movable objects, such as portable generators, coolers, portable outdoor furniture, tents, bicycles, motorcycles, and other similar items outside their home or place of business, or at campsite, tailgate, or other recreational outdoor event. These possessions are generally portable, valuable, and easy targets for theft. Often there are no facilities or other resources in such outdoor areas to secure these valuables. This presents the owner of such valuable objects with a difficult choice: either someone must remain with the valuables at all times or the valuables must be hidden or somehow secured to the site. This often results in many thefts of unattended property as people leave their valuables or inadequately secure them and thieves easily remove them. Accordingly, there is a need to provide an anchor for securing movable objects to the ground to prevent theft.

SUMMARY

The present disclosure provides for devices, systems, and methods for securing movable objects to the ground to prevent them from being removed or stolen. For example, the present disclosure provides for ground anchor devices for securing external portable objects to the ground.

In general, in a first main embodiment, the devices, systems, and methods are based on a ground anchor for securing portable objects to the ground, the anchor comprising: a main elongated shaft having upper and lower ends, a grooved locking post extending upwardly on the upper end, an auger fixed to the lower end, an engagement area between the grooved locking post and the auger and configured for releasably engaging an external device for screwing the main shaft into the ground; a sleeve slidably mounted over the main shaft between the grooved locking post and the auger, and configured to rotate freely around the main shaft and obstruct access to the main shaft to prevent persons from gripping, rotating, and removing the main shaft; an attachment member attachable to the main shaft above the sleeve, and comprising at least two holes, a first hole being suitably sized to allow the grooved locking post to pass through but not the sleeve, and at least a second hole configured to releasably secure one or more of an external lock, chain, tether, rope or cable attachable to one or more portable objects to anchor the objects when the main shaft is screwed into the ground; and a lock device configured to cover and releasably lock onto the grooved locking post so the attachment member and sleeve cannot be removed and the main shaft is covered by the sleeve.

In a second main embodiment, the ground anchor for securing external objects to the ground, comprises: a main elongated shaft having upper and lower ends, a hex shaped bolt head fixed on the upper end, and an auger fixed to the lower end for screwing into the ground when suitably driven. The ground anchor further comprises a sleeve slidably mounted over the main shaft between the hex shaped bolt head and the auger, the sleeve being configured to rotate freely around the main shaft and obstruct access to the main shaft to prevent persons from gripping, rotating, and removing the main shaft. The ground anchor further comprises a hollow security shell attachable to the hex shaped bolt head, the security shell comprising: a first shell segment and a second shell segment joined by a hinge and configured to open and close around the main shaft and the hex shaped bolt head. When closed, the security shell housing defines an internal space with a suitably sized hole at the bottom through which the main shaft can pass but not the hex shaped bolt head nor the sleeve. When closed, the sleeve cannot be removed and the main shaft is covered by the sleeve. The first and second shell segments have outwardly extending tabs with at least two holes in each tab that align when closed, at least one of the holes being configured to releasably secure a lock and at least one of the holes being configured to releasably secure to one or more of an external lock, chain, tether, rope or cable attachable to one or more portable objects to anchor the objects when the main shaft is screwed into the ground.

In a third main embodiment, the ground anchor for securing external objects to the ground, comprises: a main elongated shaft having upper and lower ends; a hex shaped bolt head fixed on the upper end of the main shaft; a collar fixed on the upper end of the main shaft below the hex shaped bolt head; an attachment member attachable to the main shaft between the hex shaped bolt head and the collar, and comprising at least two holes, a first hole being suitably sized to allow the main shaft to pass through but not the hex shaped bolt head nor the collar; and an auger fixed to the lower end of the main shaft for screwing the anchor into ground when suitably driven; wherein the at least a second hole on the attachment member is configured to releasably secure one or more of an external lock, chain, tether, rope or cable attachable to an external portable object to anchor the object when the main shaft is screwed into the ground.

These and other features, aspects, and advantages of the subject matter of this application will become better understood with regard to the following description, appended claims, and accompanying drawings.

BRIEF DESCRIPTION OF THE DRAWINGS

FIG. 1A is a perspective, pictorial representation of a first main embodiment of the ground anchor in the locked position with component parts engaged and attached to a lock device. FIG. 1B shows a close-up of the top portion of the ground anchor of FIG. 1A in the disengaged state.

FIG. 2A illustrates the ground anchor of FIGS. 1A and 1B in the unlocked position with the component parts disengaged. FIG. 2B is a close-up view of the lock device and upper end of the main shaft.

DETAILED DESCRIPTION

Figure 1A:
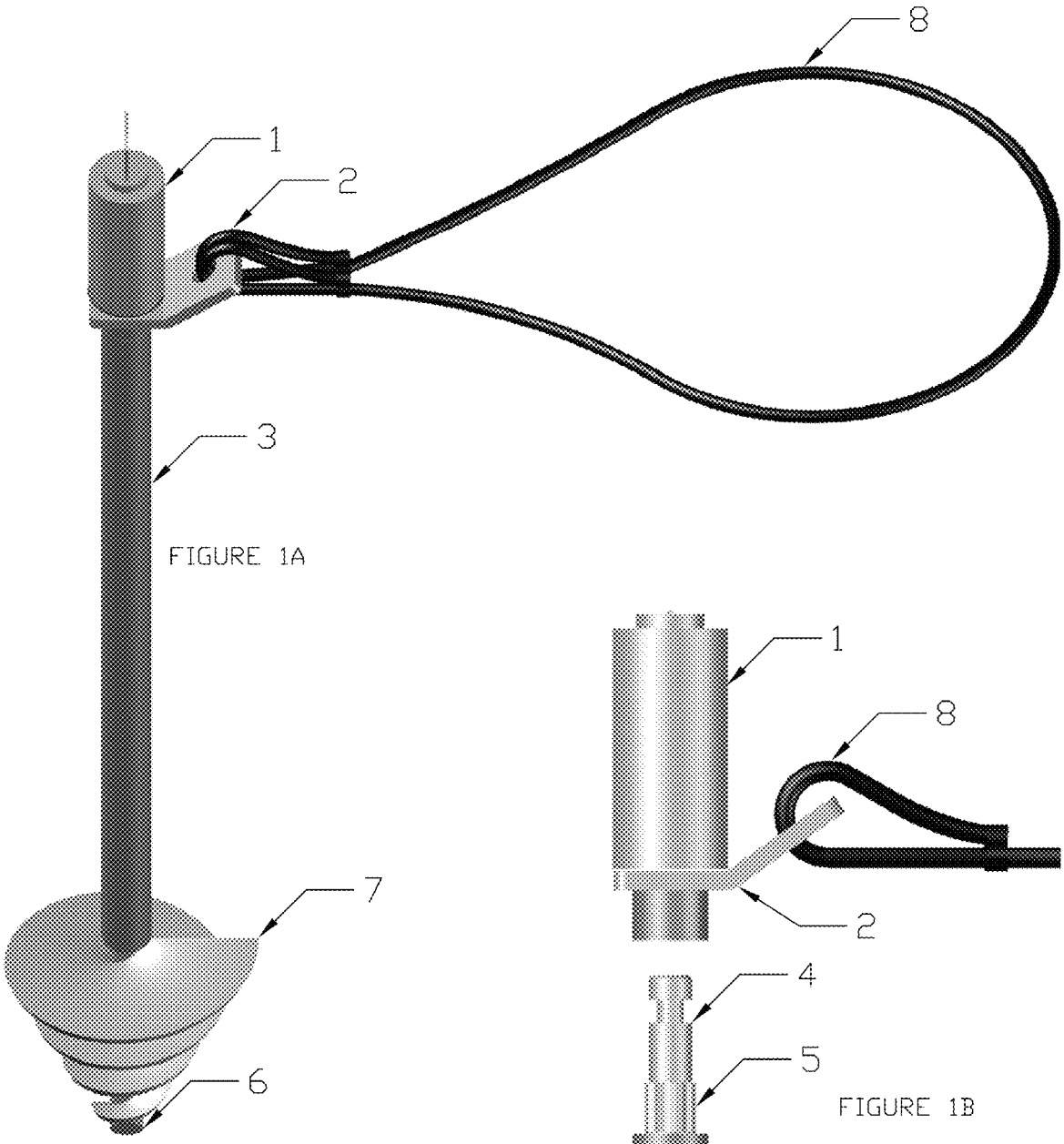
FIGS. 1A and 1B.

Detailed descriptions of one or more embodiments are provided herein with reference to the accompanying drawings, in which the embodiments are shown. It is to be understood, however, that the devices, systems and methods according to this disclosure may be embodied in various forms. Therefore, specific details disclosed herein are not to be interpreted as limiting, but rather as a representative basis for the claims and for teaching one skilled in the art to employ the present devices, systems and methods in any appropriate manner. Accordingly, the present devices, systems and methods of the disclosure may be embodied in many different forms and should not be construed as being limited to the embodiments set forth herein; rather, the embodiments are provided so that this disclosure will be thorough and complete, and will fully convey the concept of the disclosure to one skilled in the art.

Where ever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The term "about" is meant to account for variations due to experimental error. All measurements or numbers are implicitly understood to be modified by the word about, even if the measurement or number is not explicitly modified by the word about.

The terms "comprising" and "including" and "having" and "involving" and the like are used interchangeably and have the same meaning. Similarly, "comprises", "includes," "has," and "involves" and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Where ever the terms "a" or "an" are used, "one or more" is understood unless explicitly stated otherwise or such interpretation is nonsensical in context.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of embodiments of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "on" versus "directly on", "between" versus "directly between", "adjacent" versus "directly adjacent", etc.).

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

The present disclosure relates to devices, systems, and methods for securing personal objects to the ground to prevent them from being removed or stolen.

In a first main embodiment, the devices, systems, and methods are based on a ground anchor for securing portable objects to the ground, the anchor comprising: a main elongated shaft having upper and lower ends, a grooved locking post extending upwardly on the upper end, an auger fixed to the lower end, an engagement area between the grooved locking post and the auger and configured for releasably engaging an external device for screwing the main shaft into the ground; a sleeve slidably mounted over the main shaft between the grooved locking post and the auger, and configured to rotate freely around the main shaft and obstruct access to the main shaft to prevent persons from gripping, rotating, and removing the main shaft; an attachment member attachable to the main shaft above the sleeve, and comprising at least two holes, a first hole being suitably sized to allow the grooved locking post to pass through but not the sleeve, and at least a second hole configured to releasably secure one or more of an external lock, chain, tether, rope or cable attachable to one or more portable objects to anchor the objects when the main shaft is screwed into the ground; and a lock device configured to cover and releasably lock onto the grooved locking post so the attachment member and sleeve cannot be removed and the main shaft is covered by the sleeve.

The main shaft is cylindrical or has a generally cylindrical shape and has an upper end and a lower end. The upper end of the main shaft includes a grooved locking post, extending upwardly, which is configured to be inserted into and secured to a lock device. The grooved locking post has an upper neck portion having a relatively smaller diameter than the main shaft and a head juxtaposed on top thereof having a relatively larger diameter than the neck. The grooved locking post is configured to pass through a hole in an attachment member and then be inserted into a lock device, which clamps on to (locks) the head and secures it, thereby locking the component parts of the ground anchor lock into place.

The lower end of the main shaft includes an auger for boring/screwing the main shaft into the ground when suitably driven, usually with the assistance of a tool. The auger is configured to any suitable size and shape and is designed to be removable in that it can be screwed in and out of the ground. In one embodiment, the auger diameter at its widest varies from 2.0 inches to 6.0 inches with an average of a 1.0 inch space between blades depending on the environment and working load. In one embodiment, the auger is an earth or soil auger having a threaded, rotating, helical shaft that spirals down to a tip. The auger has a single spiral blade, double spiral blade, or half-duplex spiral blade fixedly attached thereto for boring into the earth. The auger tip can be formed into any suitable size and shape. For instance, the auger tip has a regular shaped tip point, a chisel-shaped point, or a cutting tip for more effective penetration in the ground. In another example, the auger tip is shaped to give it a reducing spiral, much like a screw.

The main shaft can be designed to any suitable length and diameter. Typical shaft size is one half inch diameter and 18 to 36 inches in length with variations as appropriate. In one embodiment, the ground anchor lock has a main shaft length generally in the range of about 10 to 60 inches. Further, the main shaft length is selected from the group consisting of 10, 12, 14, 16, 18, 20, 22, 24, 26, 28, 30, 32, 34, 36, 38, 40, 42, 44, 46, 48, 50, 52, 54, 56, 58, and 60 inches. The maximum diameter of thickest part of the auger is the range selected from the group consisting of 1, 2, 3, 4, 5, 6, 7, 8, 9, 10, 11, and 12. In one embodiment, the ground anchor lock has a main shaft length of 36 to 48 inches and maximum auger diameter of about 6 inches. In an alternative embodiment, the main shaft length is 18 inches and maximum auger diameter is 4 inches.

To prevent the ground anchor lock from being removed by a thief, the main shaft and auger is driven into the ground to a depth suitable to make removal of the ground anchor lock difficult without access to the main shaft. For instance, in one embodiment, the main shaft and auger is driven into the ground to a depth of about 12 to 48 inches, including depths of 18 inches, 24 inches, 36 inches, 48 inches, and so on. In one embodiment, the main shaft and auger is driven into the ground so that everything is underground except for the tie-down bracket, attachment member, and lock device. In a further embodiment, only the portion of the upper end of the main comprising the tie down bracket and the keyed lock remain above ground when all component parts are engaged to the ground anchor lock.

The engagement area of the main shaft is generally positioned between the grooved locking post (on the upper end of the main shaft) and the auger portion (on the lower end of the main shaft), and in one embodiment, it is situated on the upper end of the main shaft in relatively close proximity to the grooved locking post. The engagement area is suitably shaped to work with a variety of tools, including power tools, such various drills, sockets, wrenches (e.g., lug wrench) pliers, etc., so a person may grip it and more easily drive the auger and main shaft into the ground. In one embodiment, the engagement area is a shank, such as those found on the end of a drill bit and is grasped by the chuck of a drill. Such shanks include straight shanks, brace shanks, hex shanks, SDS shanks, triangle shanks, morse taper shanks, square shanks, etc. When in use, the main shaft is drivingly linked, via the shank/engagement area, to a drill or other portable rotary machine. The drill chuck matingly receives the outer surface of the shank/engagement area as is common for tools, such as drill bits, and once tightened, drivingly links the rotary motor of the drill to the engagement area, and thereby drivingly links to the tool. In an another embodiment, the engagement area is shaped like a spline or nut with edges, such as a hex nut, or has teeth to engage a tool, such as a wrench or socket (which in turn can be powered by a rotary machine).

The sleeve of the ground anchor lock is generally in the shape of cylindrical tube made of case-hardened steel. The sleeve has a relatively larger circumference than the main shaft, so the sleeve slidably mounts over and slides all the way down the main shaft until it abuts against the edge of the auger on the lower end of the main shaft. In this manner, the sleeve is generally positioned on the main shaft between the top edge of the auger on the lower end and the bottom edge of the grooved locking post and/or engagement member. In general, the diameter of the sleeve is larger than the hole in the engagement member/tie down bracket. This size difference prevents the tie down bracket from sliding down the main shaft. The length of the sleeve is generally sized such that, when it is slid over the main shaft and the tie down bracket is on, the sleeve covers the main shaft spanning from the bottom of the tie down bracket on the area just below the grooved locking post (that inserts into the lock device) to the top of the auger on the lower end, i.e., the sleeve length corresponds to the distance between the auger and the grooved locking post. Accordingly, when this embodiment is in use, the sleeve extends from the top edge of the auger on the lower end of the main shaft up to the bottom of the attachment member, when the grooved locking post is engaged with a lock. In an alternative embodiment, the sleeve is sized to extend from the top edge of the auger up to and through the hole in the attachment member and up against the housing of the lock device. In a further embodiment, the top end of the sleeve (in contact with the tie down bracket) has a collar or flange with a diameter slightly larger than the hole in the tie-down bracket to thereby prevent the tie down bracket from sliding down and over the sleeve. Either way, the sleeve is configured so that when the component parts are engaged it obstructs access to the main shaft and rotates (spins) freely around the main shaft to prevent unauthorized persons from gripping, rotating, and removing the main shaft.

The attachment member of the ground lock anchor is attachable to the main shaft and generally positioned between the sleeve and the lock device. The attachment member may be configured into various shapes and structures and is adapted to releasably secure one or more external portable objects to the grooved locking post on the main shaft. In one embodiment, the attachment member has at least two or more holes or loops, at least one of which is suitably sized to allow the main shaft and the grooved locking post thereon (and in one embodiment the sleeve tube) to pass through it; and the at least one other hole/loop is suitably sized to secure (fasten to) one or more of an external lock, such as a pad-lock, or to run a chain, tether, cable, rope, leash, or strap through that is attachable to the external portable object.

In one example, the attachment member is a tie-down bracket with at least two suitably sized holes on opposing ends of the bracket. A first hole at one end is suitably sized to allow the main shaft and the grooved locking post thereon (and optionally the sleeve tube) to pass through it. The other hole at the other end is suitably sized to secure a lock, such as a pad-lock to it, or to run a cable, tether, chain, rope, leash, or strap through it, which is then secured to the external portable object. The tie-down brackets are made of steel (e.g., case-hardened steel) and may be powdered coated a certain color (or no color). The tie-down brackets are configured to have various shapes and sizes. For instance, in one embodiment, the brackets are straight or have a mounting angle to make it easier to attach a lock or to hook up a, rope, chain, straps by spacing the anchor away from the ground to provide easier access to the tie-down hole. The mounting angle is of any suitable angle, and in one embodiment includes angles in a range of 30° to 90°, including representative mounting angles of 30°, 35°, 40°, 45°, 50°, 55°, 60°, 65°, 70°, 75°, 80°, 85°, and 90°. Other applications utilize existing mounting and fastening holes commonly found in equipment being secured; for example, tent pole feet have holes for staking down which could be slipped over the shaft of the auger lock shaft and secured with locking device.

The lock device of the ground anchor lock is configured to attach/lock onto the head of the grooved locking post on the upper end of the main shaft. In one embodiment, the lock device is keyed so a person can use a key to lock (or unlock) the device to the head of the grooved locking post. In this regard, the lock device comprises a housing/sleeve and a key mechanism operably connected to locking teeth, whereby the housing covers all but the key slot entry (usually on top) and the entry to the lock (usually on bottom). The lock device housing is of any suitable shape, including cylindrical, circular, rectangular or square, so long as at least a portion of the housing (generally located at the bottom of the housing) is larger in size than the diameter of the hole in the attachment member through which the grooved locking post passes. The larger size of the lock device prevents the attachment member from being removed when the lock device is engaged and locked to the head. When in use and locked, the lock device housing covers the entirety of the grooved locking post, whereby the locking teeth securely grab/engage the neck of the grooved lock post, thereby grasping and locking onto the head. In doing so, the lock device housing abuts against the attachment member and prevents it from being slid over and off the grooved locking post, and consequently, the attachment member abuts against the sleeve tube and thereby prevents the sleeve tube from being slid off and removed from the main shaft. In one embodiment, the lock device is optionally configured so that when locked onto the post, it remains free to spin around the main shaft. In a further embodiment, the sleeve tube may pass through the hole in the attachment member and either be inserted into the entry of the lock device or rest against the larger sized housing of the lock device. In either embodiment, when locked, both the attachment member and sleeve tube cannot be removed and the sleeve tube, which is free to spin (and optionally the lock device may spin) completely covers the remainder of the main shaft all the way down to the auger portion. Either way, the arrangement of the lock and sleeve prevents unauthorized persons from accessing the main shaft and thereby prevents them from gripping the main shaft and removing it from the ground. In other applications, a combination style lock may be substituted and utilized to meet user needs and preferences.

Figure 1B:
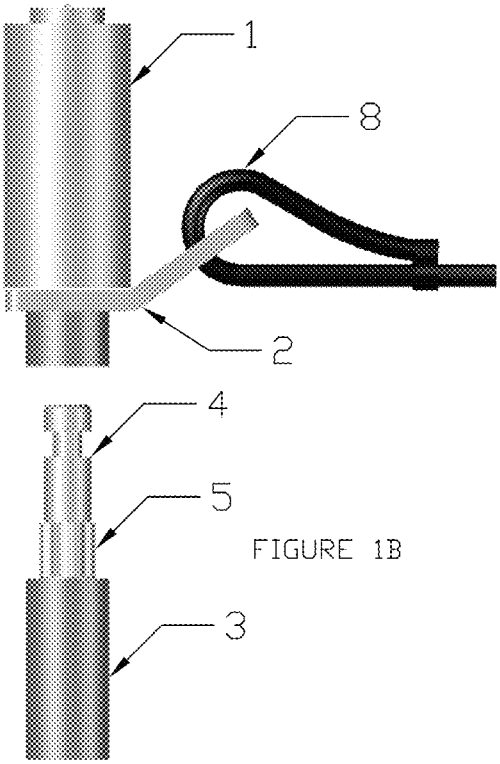

Referring now to the Figures, wherein like reference numerals refer to like parts throughout, FIG. 1A is a perspective, pictorial representation of the first main embodiment of the ground anchor in the locked position with component parts engaged and attached to keyed lock 1. Sleeve 3 mounts and covers the main shaft (covered part not visible) from the bottom of attachment member 2 on the upper end of the main shaft down to the edge of auger 7 at the lower end. The upper end of the main shaft extends through an aperture (not shown) in attachment member 2 and the grooved locking post (not shown) is inserted into and locked to keyed lock 1. As shown, attachment member 2 is tie-down bracket 2 with mounting angle attached to cable 8. FIG. 1B illustrates a close-up of the keyed lock 1 disengaged and removed from the top, revealing grooved locking post 4 and toothed engagement member 5 below it.

Figure 2A:
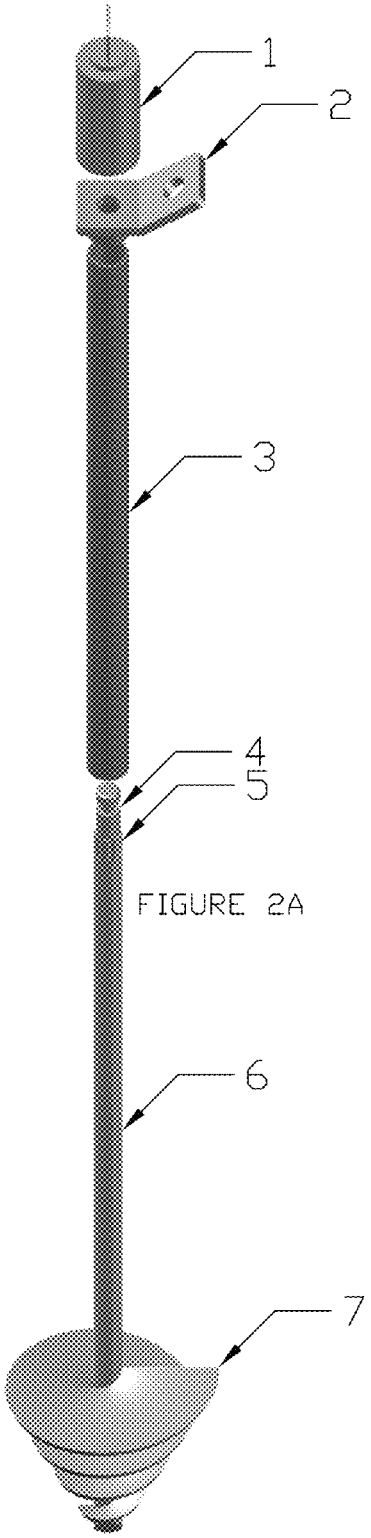
FIGS. 2A and 2B.
Figure 2B:
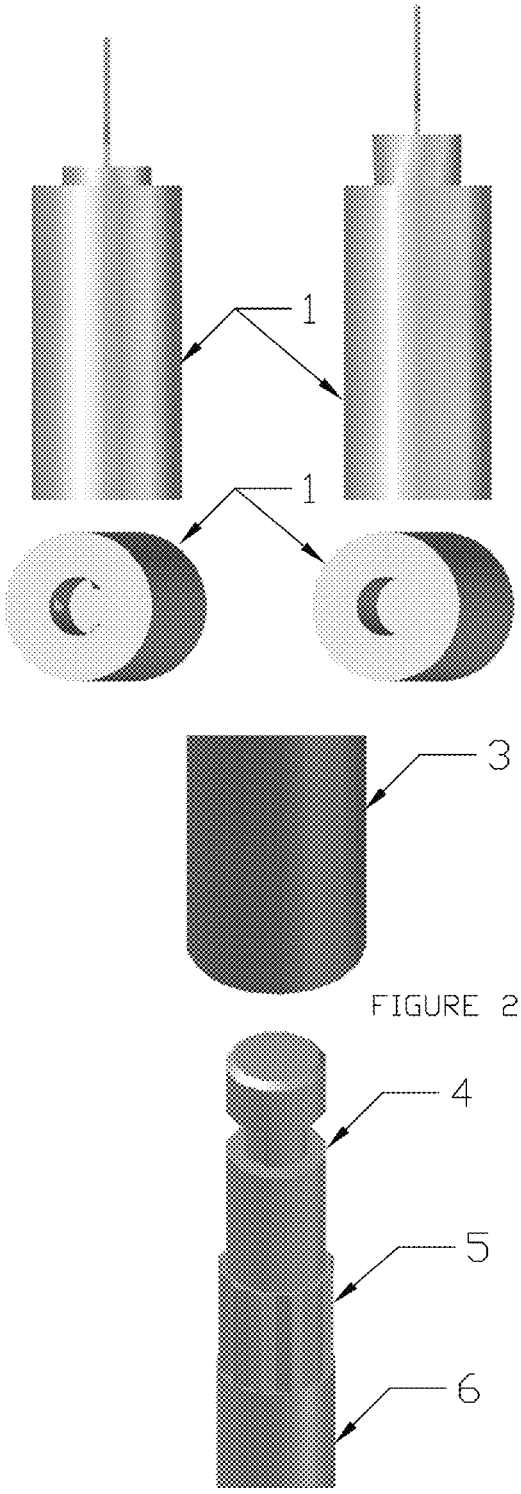

FIG. 2A illustrates the ground anchor of FIGS. 1A and 1B in the unlocked position with the component parts disengaged—keyed lock 1 is disengaged, attachment member/tie-down bracket 2 is removed, and sleeve 3 is slid off/removed from main shaft 6, revealing grooved locking post 4 and toothed engagement member 5 (with teeth or spline) below grooved locking post 4. FIG. 2B is an enlarged view of the region of the upper end of the shaft depicting keyed lock 1 being removed from grooved locking post 4. FIG. 2B shows a close-up of grooved locking post 4 and toothed engagement member 5 (with teeth or spline) below it. FIG. 2B further illustrates a lengthwise view and a cross-sectional view of the bottom of keyed lock 1. The bottom cross-sectional view shows the entry point into which grooved locking post 4 is inserted and locked. Locking teeth are visible on the inner walls of the cylindrical entry point, and these locking teeth securely grab the neck of grooved locking post 4.

A second main embodiment is similar to the ground anchor lock of the first main embodiment except that it has a hollow security shell covering the top of main shaft, instead of a keyed lock device, and it does not use the attachment member. In this second main embodiment, the ground anchor has a main elongated shaft having upper and lower ends, a hex shaped bolt head on the upper end, and an auger fixed to the lower end for screwing into the ground when suitably driven. A sleeve is slidably mounted over the main shaft and positioned between the hex shaped head and the auger. The sleeve is configured to rotate freely around the main shaft and obstruct access to the main shaft.

In the second main embodiment, the anchor has a hollow security shell with a first shell segment and a second shell segment joined by a hinge that, when closed, covers the top of the main shaft, including the tie down bracket. The hollow security shell is configured to open and close around the main shaft and the hex shaped bolt head. The first and second shell segment are configured, so that when closed, they define an enclosed, internal space with an aperture at the bottom. In this regard, each of half of the she has semi-circular holes which, when each security shell is closed, creates a circular aperture/hole slightly larger in size to the diameter of the main shaft, but smaller than the diameter of the hex shaped bolt head and smaller than the collar/flange feature when utilized.

In the second main embodiment, the hex shaped bolt head has a diameter greater than that of the main shaft, the sleeve, and the aperture/hole created by the closed shell segments. In this manner, the aperture/hole is suitably sized to allow the main shaft to pass through it, but not the sleeve nor the hex shaped bolt—which have a larger diameter than the aperture/hole. When closed, the hollow security shell encloses around the hex shaped bolt head and the portion of the main shaft passing through the aperture/hole at the bottom. The closed hollow security shell freely rotates around the main shaft and prevents access to the hex shaped bolt head and prevents the sleeve from being removed from the main shaft. In a further embodiment, a collar/flange (e.g., a washer welded to the upper end of the main shaft) is attached to the upper end of the main shaft below the hex shaped bolt. The collar/flange is larger in diameter than the aperture/hole in the closed security shell and is positioned inside the hollow security shell when it is closed.

Both the first and second shell segments have outwardly extending tabs and with at least two holes in each tab. When the hinge connecting the two half shells is closed, the tabs and their associated holes/apertures align. At least one of the aligned holes accommodates a locking device (not shown) located on the side of the security shell opposite of the hinge. The other aligned holes accommodate a chain, cable, tether, strap, rope, etc. attached to an external, portable object to thereby anchor the object when the main shaft is screwed into the ground and device is locked. The axis of rotation of the hinge is parallel to the longitudinal central axis of the main shaft and the longitudinal central axis of the security shell. The closed shell may take the form of any shape, including for instance, a cylindrical tube, box, or circle.

Figure 3:
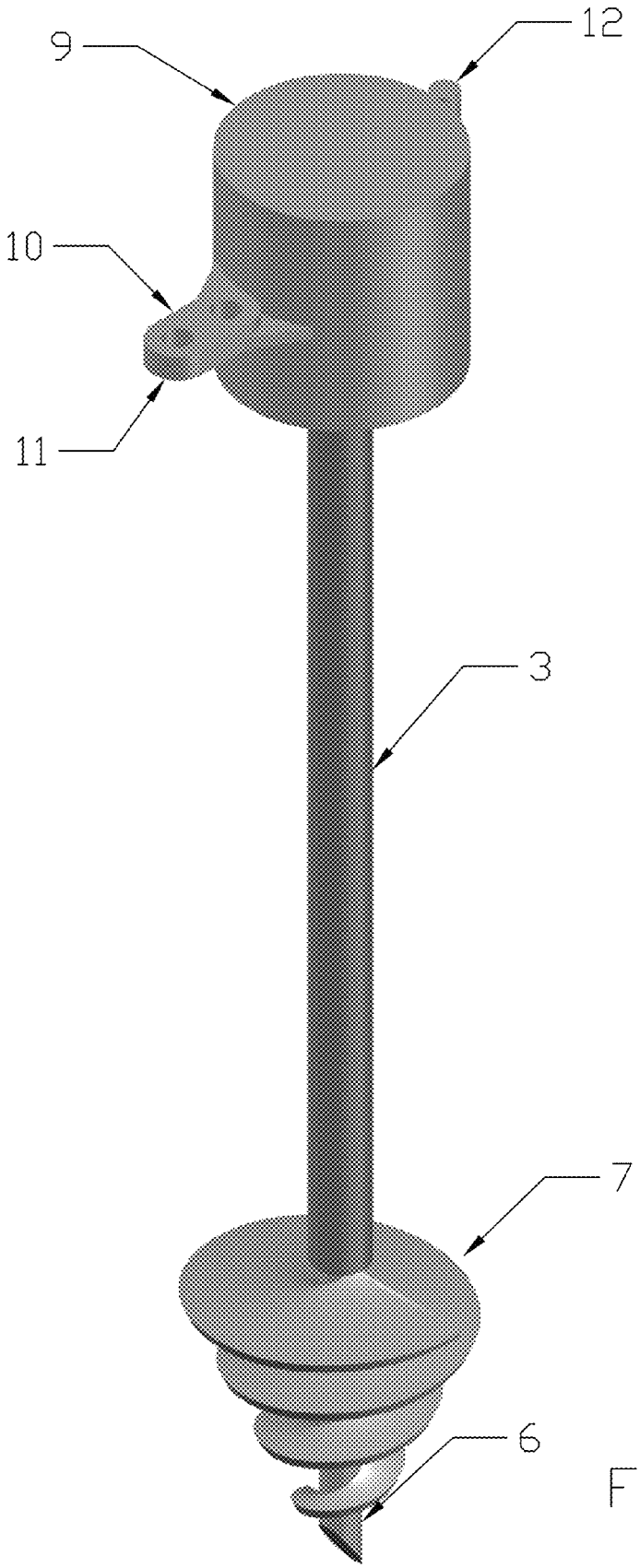
FIG. 3 is a perspective, pictorial representation of a second main embodiment in which the ground anchor contains hollow security shell having a first shell segment and second shell segment joined by a hinge and configured to open and close around the hex shaped bolt head on the upper portion of main shaft.

Referring now to the Figures, FIG. 3 is a perspective, pictorial representation of the second main embodiment in which the ground anchor includes a closed hollow security shell 9 made by closing the first shell segment and second shell segment, which are joined by a hinge 12. Hollow security shell 9 is configured to open and close around the hex shaped bolt head (not shown) on the upper portion of main shaft 6. In FIG. 3, hollow security shell 9 is closed thereby encapsulating the hex shaped bolt head (not shown) and the portion of the main shaft (not shown) passing through the aperture/hole (not shown) at the bottom of hollow security shell 9. Each shell segment has outwardly extending tabs 10, 11 (opposite hinge 12) with at least two holes in each and configured such that when the segments close, the tabs and holes align. Sleeve 3 is on and covers main shaft 6 down to the top edge of auger 7.

Figure 4:
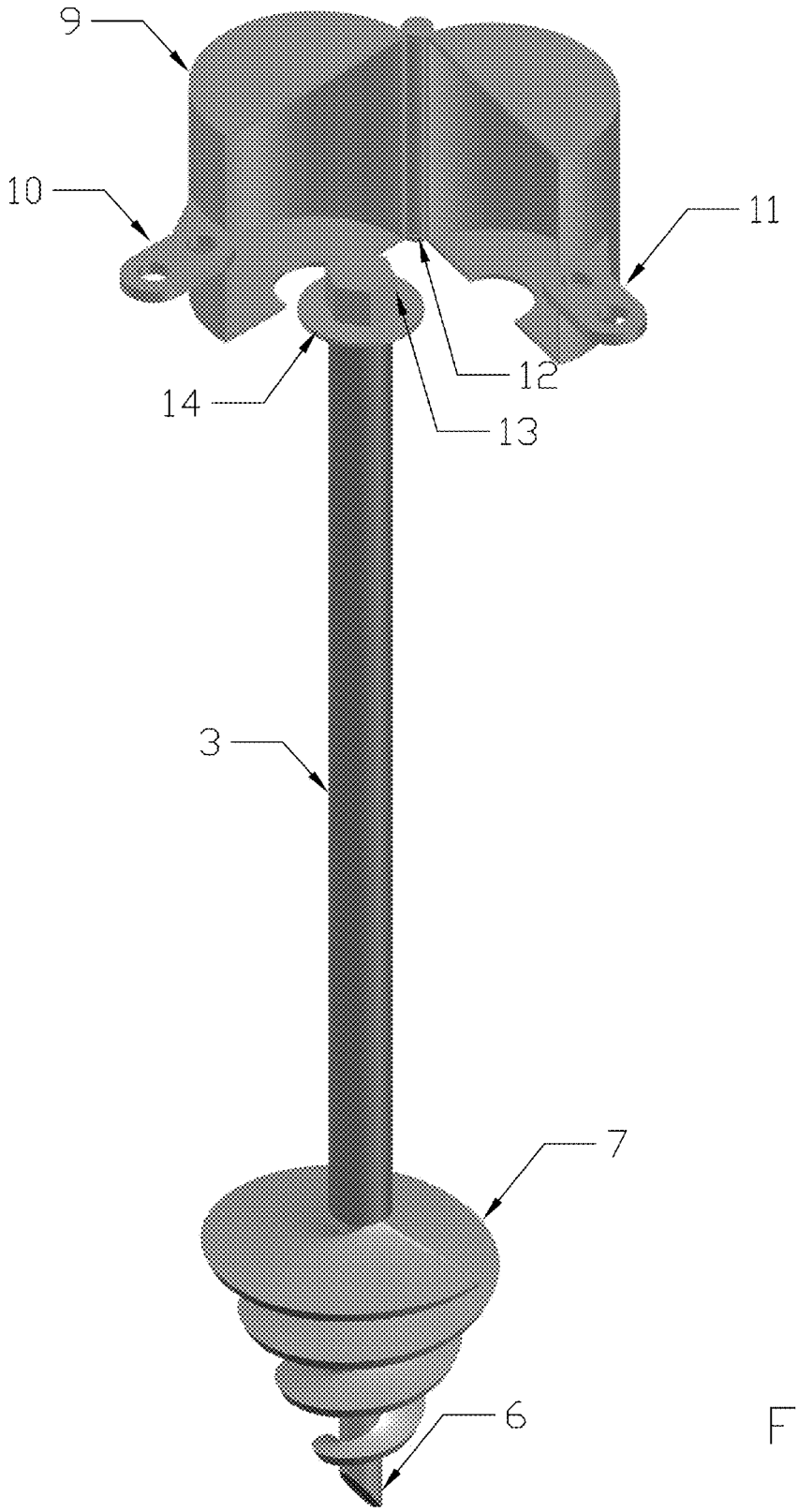
FIG. 4 illustrates the ground anchor in FIG. 3, in which the first and second shell segments of hollow security shell are open and the hollow security shell is disengaged.

FIG. 4 illustrates the ground anchor in FIG. 3, in which the first and second shell segments of hollow security shell 9 are opened so the hollow security shell 9 is disengaged from main shaft 6, thereby revealing the hex shaped bolt head 13 and the collar/flange 14 on the upper end of the main shaft 6 just. In FIG. 4, the first and second shell segments of hollow security shell 9 are opened and thus the outwardly extending tabs 10, 11 are not aligned.

A third main embodiment is similar to the above-described first main embodiment except it lacks the grooved locking post, sleeve, and the lock device. Instead, a hex head is placed on the top end of the shaft with a tie-down bracket below the head on the shaft. In this manner, the anchor of the third main embodiment comprises: a main elongated shaft having upper and lower ends; a hex shaped bolt head fixed on the upper end of the main shaft; a collar fixed on the upper end of the main shaft below the hex shaped bolt head; an attachment member attachable to the main shaft between the hex shaped bolt head and the collar, the attachment member comprising at least two holes, a first hole being suitably sized to allow the main shaft to pass through but not the hex shaped bolt head nor the collar; and an auger fixed to the lower end of the main shaft for screwing the anchor into ground when suitably driven; wherein the at least second hole on the attachment member is configured to releasably secure one or more of an external lock, chain, tether, rope or cable attachable to an external portable object to anchor the object when the main shaft is screwed into the ground.

Figure 5:
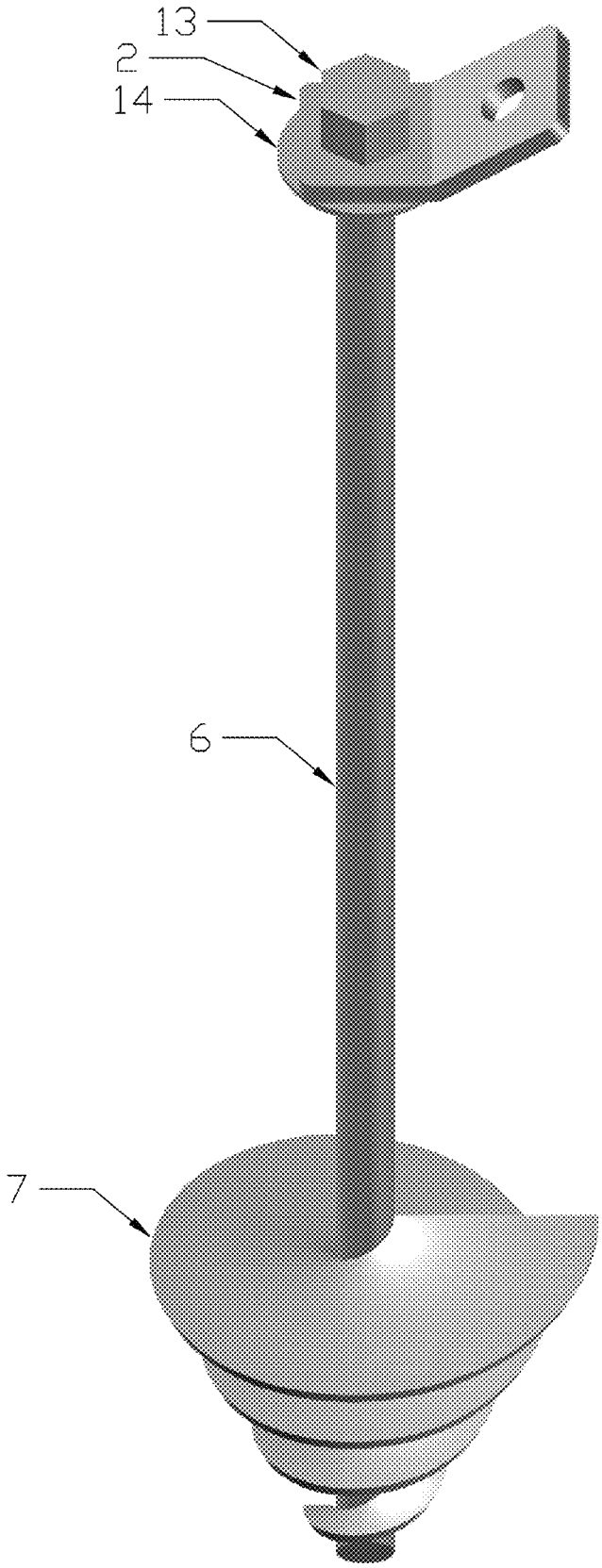
FIG. 5 is a perspective, pictorial representation of a third main embodiment of a non-locking ground anchor having a main shaft with a hex shaped bolt head on the upper end, an auger on the lower end, a tie-down bracket below the hex shaped bolt head, and no sleeve or lock device.

Referring now to the Figures, FIG. 5 is a perspective, pictorial representation of the third main embodiment of a non-locking ground anchor having a main shaft 6 with a hex shaped bolt head 13 on the upper end, an auger 7 on the lower end, a tie-down bracket 2 (with mounting angle) below the hex shaped bolt head 13. As shown, a collar/flange 14 (e.g., a washer welded to the upper end of the main shaft) is attached to the upper end of the main shaft 6 below the hex shaped bolt head 13 to prevent the tie-down bracket 2 from sliding down the shaft.

Figure 6:
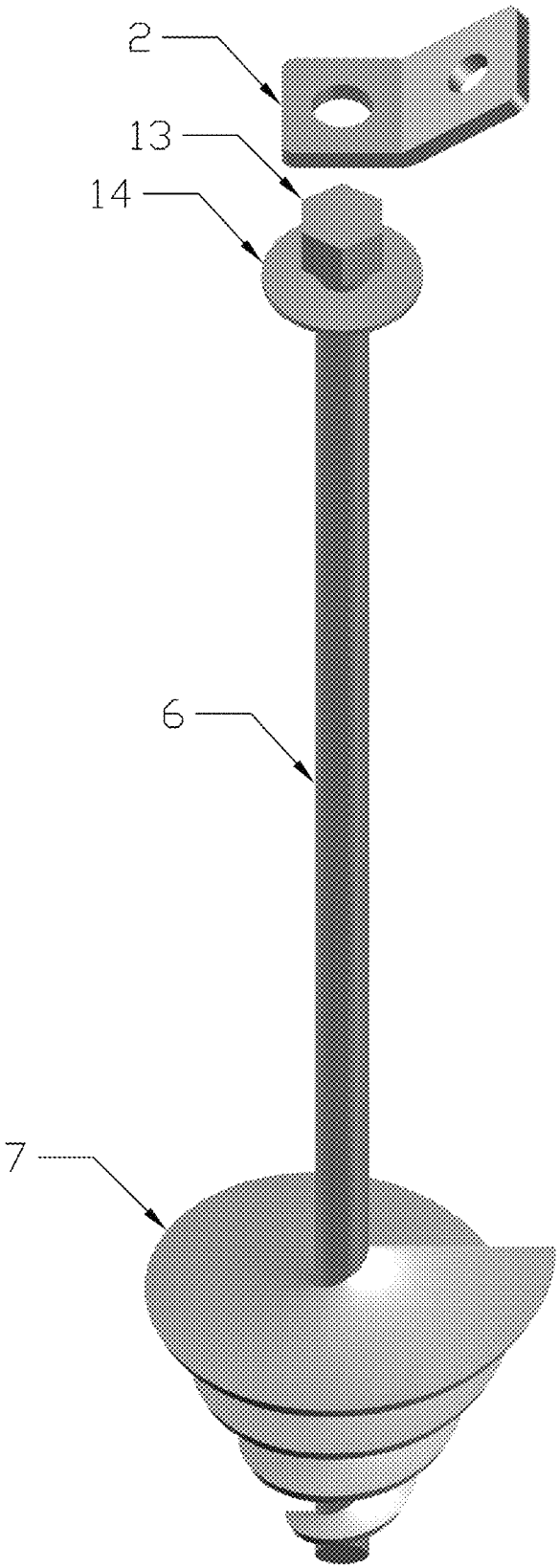
FIG. 6 illustrates the non-locking ground anchor of FIG. 5, except the tie-down bracket is removed from the main shaft.

FIG. 6 illustrates the non-locking ground anchor of FIG. 5, except tie-down bracket 2 is removed from main shaft 6. The two apertures/holes in the tie-down bracket 2 are shown.

One or more components of the ground lock anchor is made from various metals, such as steel and/or iron, including case-hardened steel, and/or galvanized steel, and are optionally adapted to be rust resistant. In one embodiment, the component parts are made from steel, which is 1144 steel or 1045 steel. In addition, the steel parts can be hot-dipped in zinc after being stamped to create a coating that is typically 3 mil to 5 mil thick. This thick, all-around coating allows galvanized steel products to provide years of use without rusting or corroding. In another embodiment, the component parts are powdered coated a certain color.

Any reference cited above is hereby incorporated by reference into the application, whether specifically incorporated or not.

Having now generally described the above-noted embodiments of the application, the same will be more readily understood through reference to the following materials, methods, and examples which are provided by way of illustration, and are not intended to be limiting, unless otherwise specified.

EXAMPLES

The following methods and materials are used in various forms of the Examples that follow as well as in carrying out certain embodiments of the disclosure.

Example 1

In this example, an auger style ground anchor was modified and configured with a receiver hitch security lock. The loop end of an auger style ground anchor was cut off and removed. Typically, the loop end of the anchor (which was removed here) is used to manually screw such devices into the ground by hand (which is difficult to do). The anchor was then inserted into a lathe, and the modified end of the anchor (that originally had the loop on it) was turned down to about 0.4375 inches. Then, a groove was cut into the shaft about 0.25 inches from the modified end. The groove, which was about 0.25 inches wide by about 0.125 inches deep, will accept an existing lock assembly off a receiver hitch lock. The groove allows the lock to grab the anchor shaft, and once locked it remains free spinning on the shaft. This prevents someone from manually removing the anchor from the ground. An industrious thief might dig into the dirt and attempt to twist the shaft itself, so a metal sleeve, also free spinning, was used to encapsulate the shaft to thwart this possibility.

Next, an oblong hole of about 0.5 by 0.75 inches was punched in the center of a 2.0 inch circle of flat steel plate. Then, a cut was made from the outer edge to the hole in the center on one side. The circle was put in a vice and separated it at the slot to create an additional auger section. This was attached to the existing auger on the modified anchor to create additional threads to the anchor. Once welded in place, it was ground down to give a reducing spiral to the anchor much like a screw. This makes driving the anchor into the ground easier.

Next, on the opposite end of the shaft below where the lock mechanism is fitted a spline or hex was cut into the shaft to accept a socket that can be attached to either a ratchet style wrench or a power tool such as drill or impact wrench. This simplifies installation of the anchor into the ground.

Lastly, the tie down bracket was made to provide a means to attach the anchor to an object to be secured. A $3/16^{th}$ inch piece of flat steel plate was cut to 2.5 by 1.25 inches. A 9/16 inch hole was punched into each end of the plate. The plate was bent in the middle to a 45° angle, thus creating the mounting angle. The mounting angle allows one hole to slide over the anchor shaft, while the other hole sticks up above the ground making it easier to access for securing items.

The resultant locking ground anchor was easily screwed into the ground by using a ratchet style wrench or a power tool, such as drill or impact wrench. The only part of the anchor remaining above ground was the upper part of the shaft with the cut groove and a portion of the top of the sleeve. The tie down bracket was then put over the groove and flush up against the top of the portion of the sleeve sticking up out of the ground. The lock was then applied and locked onto the groove, thereby holding the tie down bracket between the lock and the top of the sleeve, so that the entire shaft was covered. After doing so, it was not possible to grasp the shaft and remove the anchor due to the spinning sleeve and lock device.

Example 2

After realizing the ease by which the anchor of Example 1 could be screwed into the ground, the same design of Example 1 was reconfigured to a non-locking application for anchoring a wide variety of objects (sheds, tents, etc.). In this manner, a similar anchor was manufactured, but instead of a lock groove on the top end of the anchor shaft or using a sleeve, a ¾ inch hex head was placed on the top end of the shaft with a tie down bracket on the shaft. The anchor was put through a variety of test situations with many types of soils and environmental conditions. In all situations it was easily driven into the ground with an electric drill and proved to be secure even under added leverage.

A number of embodiments have been described but a person of skill understands that still other embodiments are encompassed by this disclosure. It will be appreciated by those skilled in the art that changes could be made to the embodiments described above without departing from the broad inventive concepts thereof. It is understood, therefore, that this disclosure and the inventive concepts are not limited to the particular embodiments disclosed, but are intended to cover modifications within the spirit and scope of the inventive concepts including as defined in the appended claims. Accordingly, the foregoing description of various embodiments does not necessarily imply exclusion. For example, "some" embodiments or "other" embodiments may include all or part of "some", "other," "further," and "certain" embodiments within the scope of this invention.

What is claimed:

1. A ground anchor for securing portable objects to the ground, the anchor comprising:

a main elongated shaft having upper and lower ends, a grooved locking post extending upwardly on and fixed to the upper end, an auger fixed to the lower end, an engagement area between the grooved locking post and the auger and configured for releasably engaging an external device for screwing the main shaft into the ground;

a sleeve slidably mounted over the main shaft between the grooved locking post and the auger, configured to rotate freely around the main shaft and obstruct access to the main shaft to prevent persons from gripping, rotating, and removing the main shaft;

an attachment member attachable to the main shaft above the sleeve, comprising at least two holes, a first hole being suitably sized to allow the grooved locking post to pass through but not the sleeve, and at least a second hole configured to releasably secure one or more of an external lock, chain, tether, rope or cable attachable to one or more portable objects to anchor the objects when the main shaft is screwed into the ground; and a lock device configured to cover and releasably lock onto the grooved locking post so the attachment member and sleeve cannot be removed and the main shaft is covered by the sleeve.

2. The ground anchor of claim 1, wherein the grooved locking post has an upper neck portion having a relatively smaller diameter than the main shaft and a head juxtaposed on top thereof having a relatively larger diameter than the neck.

3. The ground anchor of claim 1, wherein the lock device is a keyed locking device comprising a housing containing a key mechanism operably connected with locking teeth that securely engage and lock onto the grooved locking post when locked.

4. The ground anchor of claim 1, wherein the attachment member is a tie-down bracket having at least two holes.

5. The ground anchor of claim 4, wherein at least one of the holes in the tie-down bracket is suitably sized to allow the main shaft and the grooved locking post thereon to pass through it but not the lock device nor the sleeve.

6. The ground anchor of claim 4, wherein the tie-down bracket is substantially straight or has a mounting angle.

7. The ground anchor of claim 1, wherein the engagement area is configured to work with tools, including drills, sockets, wrenches, or pliers so a person may grip the engagement area to drive the auger and the main shaft into the ground.

8. The ground anchor of claim 7, wherein the engagement area is in the shape of a shank or a hex shaped bolt.

9. The ground anchor of claim 1, wherein the sleeve is suitably sized to slide over and cover the entire main shaft except for the portion of the grooved locking post that inserts into the lock device and the auger on the lower end of the main shaft.

* * * * *